US009193555B2

(12) United States Patent
Amano et al.

(10) Patent No.: US 9,193,555 B2
(45) Date of Patent: Nov. 24, 2015

(54) PRINTER WITH PAPER SKEWING SECTION POSITIONED AFTER MANUAL CUTTER

(71) Applicant: TOSHIBA TEC KABUSHIKI KAISHA, Tokyo (JP)

(72) Inventors: Yasuo Amano, Shizuoka (JP); Tsuyoshi Sanada, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/197,504

(22) Filed: Mar. 5, 2014

(65) Prior Publication Data

US 2014/0255076 A1 Sep. 11, 2014

(30) Foreign Application Priority Data

Mar. 5, 2013 (JP) ..... 2013-042825

(51) Int. Cl.

| | |
|---|---|
| ***B26D 1/02*** | (2006.01) |
| ***B65H 35/04*** | (2006.01) |
| ***B41J 11/70*** | (2006.01) |
| ***B65H 35/00*** | (2006.01) |
| ***B65H 23/038*** | (2006.01) |

(52) U.S. Cl.

CPC ..... *B65H 35/008* (2013.01); *B26D 1/025* (2013.01); *B41J 11/70* (2013.01); *B65H 23/038* (2013.01); *B65H 2301/331* (2013.01); *B65H 2801/12* (2013.01); *Y10T 83/04* (2015.04)

(58) Field of Classification Search

CPC ..... B26D 1/025; B41J 11/70; B65H 35/10; B65H 35/008; B65H 35/04; B65H 2301/331

USPC ..... 225/23, 51

See application file for complete search history.

(56) References Cited

U.S. PATENT DOCUMENTS

| | | | | |
|---|---|---|---|---|
| 6,846,118 | B2 * | 1/2005 | Uehara et al. | 400/76 |
| 2006/0008311 | A1 * | 1/2006 | Miyasaka et al. | 400/613 |
| 2006/0280541 | A1 * | 12/2006 | Lass, Jr. | 400/611 |
| 2011/0052299 | A1 * | 3/2011 | Nam et al. | 400/621 |

FOREIGN PATENT DOCUMENTS

| | | | | |
|---|---|---|---|---|
| JP | 2001225519 | A * | 8/2001 | B41J 11/70 |
| JP | 2002103713 | A * | 4/2002 | B41J 11/70 |
| JP | 2007-118093 | | 5/2007 | |

* cited by examiner

*Primary Examiner* — Daniel J Colilla

(74) *Attorney, Agent, or Firm* — Patterson & Sheridan, LLP

(57) ABSTRACT

A printer apparatus according to an embodiment include a printing section configured to print on a roiled paper. A conveyance roller conveys the paper to a discharge port so that an end of the paper extends from the discharge port. A manual cutter blade is positioned downstream of the conveyance roller in a paper conveying direction and upstream of the discharge port in the paper conveying direction. The manual cutter blade contacts the paper and cuts the paper in a manual cutting operation. A skewed conveyance section is positioned downstream of the conveyance roller in the paper conveying direction. The skewed conveyance section conveys the paper in a manner skewed relative to the conveyance roller.

17 Claims, 6 Drawing Sheets

PRINTER WITH PAPER SKEWING SECTION POSITIONED AFTER MANUAL CUTTER

CROSS-REFERENCE TO RELATED APPLICATION

This application is based upon and claims the benefit, of priority from Japanese Patent Application No. 2013-042825, filed Mar. 5, 2013, the entire contents of which are incorporated herein by reference.

FIELD

Embodiments described herein relate to a printer apparatus, and more particularly, to a printer apparatus and method for printing on, conveying, and cutting a rolled paper.

BACKGROUND

In a printer apparatus used as a receipt or ticket issuing apparatus, after specific items are printed on a long paper pulled out from a rolled paper, the paper is cut into paper pieces with a given length and then discharged.

An automatic cutter moves a movable blade towards a fixed blade with a motor to cut the paper. However, in view of the low durability and the high cost of the automatic cutter, a mechanism may be used in which only a manual cutter blade is used. When cutting a paper with the manual cutter, a user of the printer apparatus pulls the uncut paper into contact with the manual cutter blade from the side of the paper, thereby cutting the paper.

Compared with the automatic cutter, the manual cutter is high in durability and low in cost. However, in such a mechanism, if the side end part of the paper does not correctly contact the manual cutter blade, the paper is not cut neatly.

DETAILED DESCRIPTION

A printer apparatus according to an embodiment include a printing section configured to print on a rolled paper. A conveyance roller conveys the paper to a discharge port so that an end of the paper extends front the discharge port. A manual cutter blade is positioned downstream of the conveyance roller in a paper conveying direction and upstream of the discharge port in the paper conveying direction. The manual cutter blade contacts the paper and cuts the paper in a manual cutting operation. A skewed conveyance section is positioned downstream of the conveyance roller in the paper conveying direction. The skewed conveyance section conveys the paper in a manner skewed relative to the conveyance roller.

Hereinafter, the printer apparatus according to an embodiment of the present invention is described in detail with reference to accompanying drawings.

(A First Embodiment)

Figure 1:
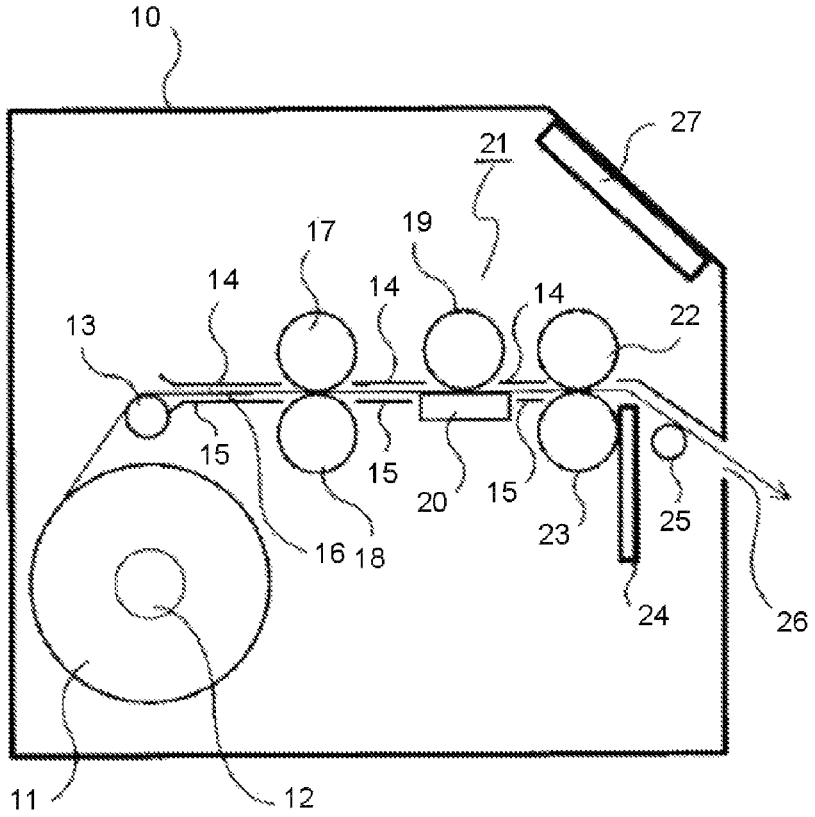
FIG. 1 is a diagram illustrating a printer apparatus, according to a first embodiment.

FIG. 1 illustrates a printer apparatus 10. In the printer apparatus 10, since a paper 11 is conveyed from the left side towards the right side in the figure. Thus the left side of the figure is regarded as a upstream side, while the right side is regarded as a downstream side in the following description. A roll of paper 11 is mounted on a winding shaft 12. The winding shaft 12 is supported in the printer apparatus 10 in a rotatable manner. An idle roller 13 is also downstream side of the roil of paper 11 in a rotatable manner. Further, at the downstream side of the idle roller 13, an upper conveyance guide 14 and a lower conveyance guide 15 are positioned. The space between the upper conveyance guide 14 and the lower conveyance guide 15 is a paper conveyance path 16 for conveying the paper 11.

Further, a first feed roller 17, which can be rotated by a motor (not shown), is positioned at the downstream side of the idle roller 13. An idle roller 18 is positioned opposite to the first feed roller 17 across the paper conveyance path 16.

A platen roller 19, which can be rotated by a motor (not shown), is positioned at the downstream side of the first feed roller 17. A thermal print head 20 is arranged opposite to the platen roller 19 across the paper conveyance path 16. The platen roller 19 and thermal print head 20 constitute a printing section 21. When the paper 11 is conveyed on the paper conveyance path 16 towards the downstream side, thermal print head 20 carries out printing row by row, matching with the conveyance of the paper 11. The thermal print head 20 is pressed against the platen roller 19. The paper 11 is conveyed towards the downstream side through the friction between thermal print head 20 and the platen roller 19.

A second feed roller 23, which can be rotated by a motor (not shown), and an idle roller 22 opposite to the second feed roller 23 are arranged across the paper conveyance path 16, downstream of the printing section 21. A discharge port 26 arranged at the front side of the printer apparatus 10. The second feed roller 23 and the idle roller 22 operated in cooperation to discharge the paper 11 out of the printer apparatus 10 from the discharge port 26.

Further, a manual cutter blade 24 is arranged downstream of the second feed roller 23 and upstream of the discharge port 26. An operator using the printer apparatus 10 grips and pulls the paper 11 coming out of the printer apparatus 10 from the discharge port 26, and outs the paper 11 by contacting a part of the paper with the manual cutter blade 24.

A skewed roller 25 (paper skewed conveyance section, which will foe described later) is arranged downstream of the manual cutter blade 24 and upstream side the discharge port 26.

A display section 27 is arranged in the printer apparatus 10 to display an error situation such as running out of paper 11, a paper jam and the like, and various kinds of information of the printer apparatus 10.

Figure 2:
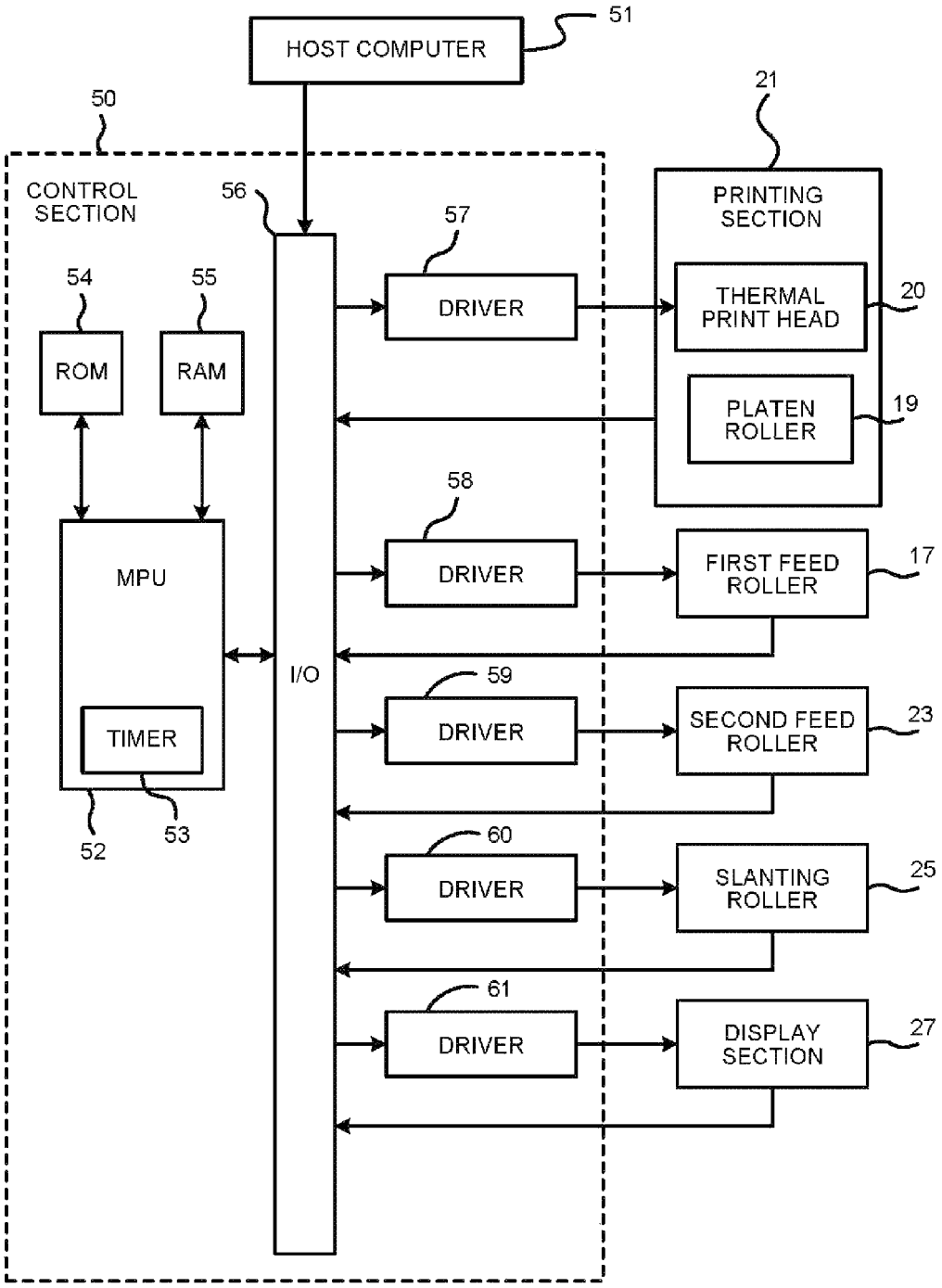
FIG. 2 is a block diagram illustrating a control circuit of a printer apparatus, according to the first embodiment.

A control section 50 of the printer apparatus 10 is shown in FIG. 2. The control section 50 controls the paper conveyance, printing, paper discharging, and the display of printer situation.

The control section 50 consists of, for example, a microcomputer for connecting with a host computer 51 and executing various controls. A micro processing unit (MPU) 52 of the control section 50 carries out a paper conveyance control, a printing control, a paper discharging control, a printer situation displaying control and the like, according to programs. The MPU 52 includes a timer 53 as a time setting unit.

A ROM 54 and a RAM 55 are arranged as primary storage units for storing control programs executed by the MPU 52 and data generated during a control process or an operation process. The ROM 54 is a read only memory in which control programs and the like are stored. The RAM 55 is a random access memory for storing the data generated during an operation process.

Further, an input/output unit (I/O) 56 is arranged in the control section 50 for acquiring various input data from the host computer 51 and exporting control output of the control section 50 to the host computer 51. The I/O 56 is connected with the MPU 52, the ROM 54 and the RAM 55 via a bus line.

Further, the I/O 56 is connected with a first driver 57, a second driver 58, a third driver 59, a fourth driver 60 and a fifth driver 61. The drivers 57-60 output various control instructions.

The driver 57 supplies a drive output for the printing section 21. The driver 58 supplies a drive output for the first feed roller 17. The driver 59 supplies a drive output for the second feed roller 23. The driver 60 supplies a drive output for the skewed roller 25. The driver 61 supplies a display drive output for the display section 27 to enable the display section 27 to execute various displays.

As shown in FIG. 1, the printing section 21 includes a thermal print head 20 and the platen roller 19. The platen roller 19 is rotationally driven by a motor (not shown) in synchronization with the printing operation, based on the control of the MPU 52. Thermal print heat 20 prints on the paper 11, based on the printing data from the host computer 51.

The MPU 52 of the control section 50 drives, with the driver 58, the first feed roller 17 to convey the paper 11.

The MPU 52 outputs control instructions to the driver 59 for the second feed roller 23 to convey the paper 11.

The MPU 52 outputs control instructions to the driver 60 for the skewed roller 25 to convey the paper 11.

The MPU 52 outputs control instructions to the driver 61 to display various kinds of information of the printer apparatus 10 on the display section 27.

Next, the operations of the printer apparatus 10 are described. The control section 50 controls paper conveyance and printing operations according to a program stored in the ROM 54.

When the paper 11 is set in the printer apparatus 10, the front end of the paper 11 is conveyed and stopped at a position between the platen roller 19 and thermal print head 20 by a paper position alignment mechanism (not shown) arranged in the printer apparatus 10. If the front end of the paper is detected by a paper sensor (not shown) arranged at the upstream side of thermal print head 20, then the paper is conveyed towards the downstream side by a given length and then stopped, until a transmission of printing data is received.

If a printing request from the host computer 51 shown in FIG. 2 is input in this state, the control section 50 operates the printing section 21 in response to the printing request. The printing data sent from the host computer 51 is printed on the paper 11. The printing is carried out through the cooperation of thermal print head 20 and the platen roller 19. The paper 11 printed by thermal print head 20 is conveyed towards the second feed roller 23 and the idle roller 22 through the rotation of the platen roller 19. Then the paper 11 is clamped and conveyed by the second feed roller 23 and the idle roller 22 towards the discharge port 26. Then the conveyance of the paper 11 is stopped at a cutting position of the paper 11 determined by the control section 50. The cutting position is consistent with the line of the blade edge of the manual cutter blade 24. At this time, the front end of the paper 11 extends out of the printer apparatus 10 from the discharge port 26.

In this state, the control section 50 drives the skewed roller 25 with the driver 60.

Figure 3:
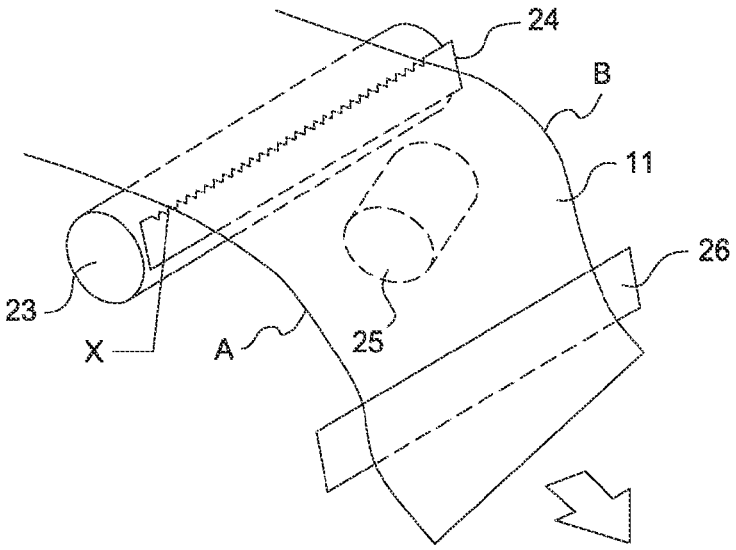
FIG. 3 is a perspective view illustrating the state of two sides of a paper when a skewed roller is driven in the printer apparatus, according to the first embodiment.
Figure 4:
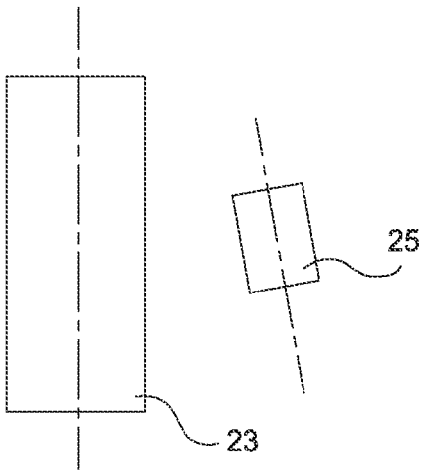
FIG. 4 is a diagram illustrating the relative arrangement between a teed roller and a skewed roller in the printer apparatus, according to the first embodiment.

FIG. 3 is a perspective view illustrating the positional relation between the second feed roller 23 and the skewed roller 25, and FIG. 4 is a plan view illustrating the positional relation between the second feed roller 23 and the skewed roller 25.

As shown in FIG. 4, the rotation axis of the second feed roller 23 is not parallel to the rotation axis of the skewed roller 25. Thus, the paper 11 conveyed toy the second feed roller 23 becomes skewed as it is conveyed by the skewed roller 25.

If the paper 11 is conveyed in a skewed manner, as shown in FIG. 3, the A edge serving as one side of the paper 11 is almost a straight line, while the B edge serving as the other side is curved and slack is generated.

In this state, the paper 11 is positioned to contact the manual cutter blade 24 correctly at an X point. In this way, the operator of the printer apparatus 10 can pull the paper 11 to cut the paper 11 correctly.

In addition, in the present embodiment, the skewed roller 25 (the skewed conveyance section) is driven in a state where the front end of the paper 11 comes out of the printer apparatus 10 from the discharge port 26. Alternatively, the skewed roller 25 may also be driven during the conveyance process of the paper 11 through the cooperation of the second feed roller 23 and the idle roller 22 towards the discharge port 26.

(A Second Embodiment)

Figure 5:
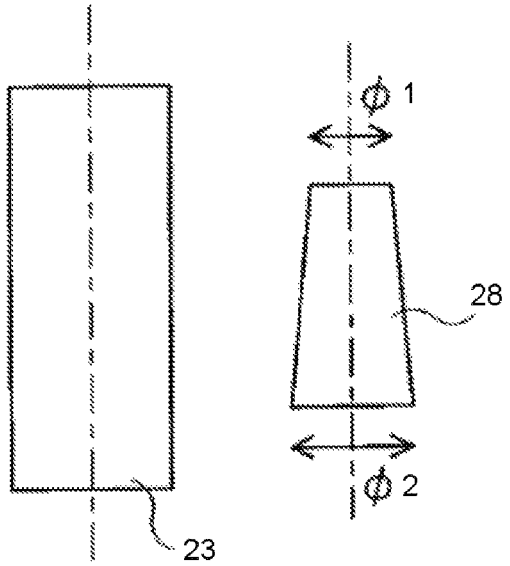
FIG. 5 is a diagram illustrating the relative arrangement between a feed roller and a skewed roller in the printer apparatus, according to a second embodiment.

FIG. 5 illustrates the second embodiment.

In the second embodiment, the rotation axis of a skewed roller 28 (serving as the skewed conveyance section) is parallel to the rotation axis of the second feed roller 23.

The skewed roller 28 has an outer surface having different diameters, that is, the diameter of one end is $\phi 1$ while the diameter of the other end is $\phi 2$, such that $\phi 1 < \phi 2$.

By making the skewed roller 28 have different diameters as shown and described, the conveyance length of the paper 11 conveyed by the skewed roller 28 at the end having the larger diameter $\phi 2$ is different from that at the other end having the smaller diameter $\phi 1$. Similarly, the paper 11 conveyed by the second feed roller 23 is also conveyed by the skewed roller 28 in a skewed manner relative to the conveyance by the second feed roller 23.

One side of the paper 11 is almost a straight line, while the other side is curved and slack is generated. Since the paper 11 at the straight line side correctly contacts the manual cutter blade 24, the operator of the printer apparatus 10 can pull the paper 11 to cut the paper 11 correctly.

Further, since the rotation axis of the skewed roller 28 is parallel to the rotation axis of the second feed roller 23, the skewed roller 28 and the second feed roller 23 may also be driven by a same driving mechanism via a gear.

(A Third Embodiment)

Figure 6:
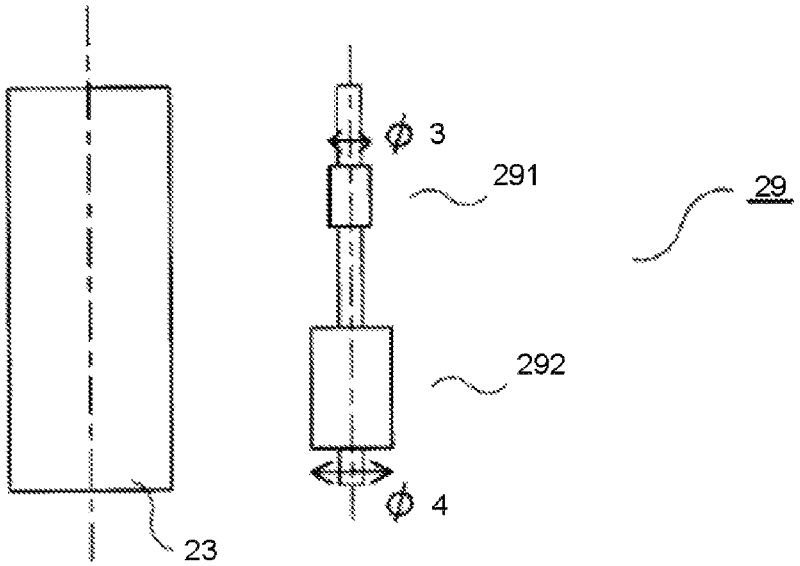
FIG. 6 is an diagram illustrating the relative arrangement between a feed roller and a skewed roller in the printer apparatus, according to a third embodiment.

FIG. 6 illustrates the third embodiment.

In the third embodiment, the rotation axis of a skewed roller 29 serving as the paper skewed conveyance section is parallel to the rotation axis of the second feed roller 23.

A small diameter roller 291, having a diameter ϕ3, and a large diameter roller 292, having a diameter ϕ4, are arranged on a same shaft in the skewed roller 29.

The diameter ϕ3 of the small diameter roller 291 and the diameter ϕ4 of the large diameter roller 292 have a relationship such that ϕ3<ϕ4. By making the skewed roller 29 have different diameters in such a manner, the paper 11 conveyed first by the second feed roller 23 and then by the skewed roller 29, is conveyed by the skewed roller 29 in a manner skewed relative to the conveyance by the second feed roller 23.

In this way, one side of the paper 11 is almost a straight line, while the other side is curved and slack is generated. Since the paper 11 at the straight line side correctly contacts the manual cutter blade 24, the operator of the printer apparatus 10 can pull the paper 11 to cat the paper 11 correctly.

Further, similar to the second embodiment, the rotation axis of the skewed roller 29 is parallel to the rotation axis of the second feed roller 23. Therefore the skewed roller 29 and the second feed roller 23 may also be driven by a same driving mechanism, for example, via a gear.

(A Fourth Embodiment)

Figure 7:
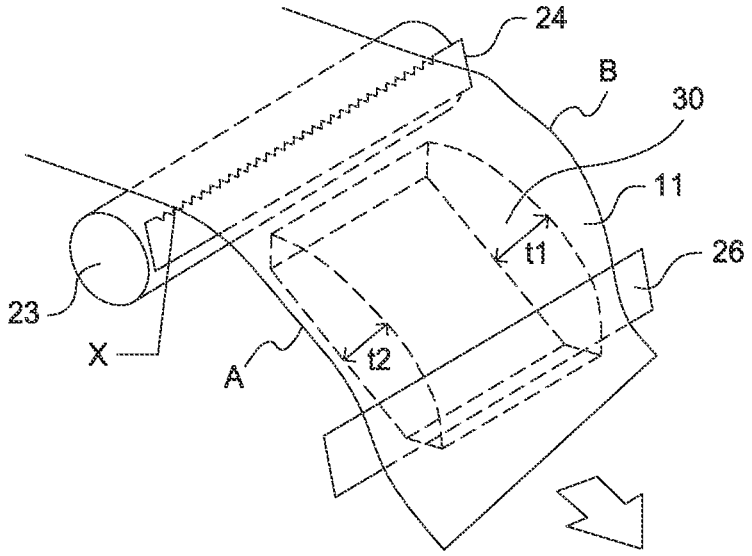
FIG. 7 is a perspective view illustrating the shape of a skewed guide in the printer apparatus, according to a fourth embodiment.
Figure 8:
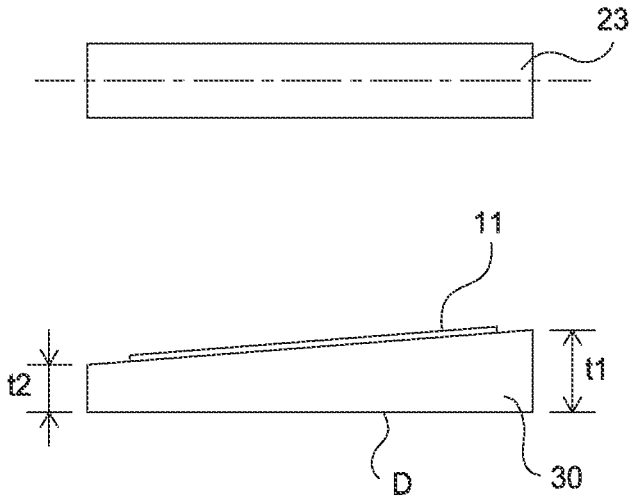
FIG. 8 is a diagram illustrating the shape of the skewed guide, according to the fourth embodiment.

FIG. 7 and FIG. 8 illustrate the fourth embodiment.

FIG. 7 is a perspective view illustrating the positional relation between the second feed roller 23 and a skewed guide 30 (the skewed conveyance section). FIG. 8 is a plan view viewed from the side of the discharge port 26 towards the side of the second feed roller 23.

The skewed guide 30 in the fourth embodiment includes a guide surface positioned under the paper 11 for guiding the paper 11. The skewed guide 30 has different thicknesses in a width direction of the paper.

As shown in FIG. 8, the second feed roller 23 is parallel to a lower surface D of the skewed guide 30. However, the thicknesses of the skewed guide 30 are different in the width direction of the paper 11. One side (in the paper width direction) of the skewed guide has a thickness t1 and the other side of the skewed guide has a thickness t2, such that t1>t2 from the lower surface D.

Since t1>t2, one side edge of the paper 11 guided by the skewed guide 30 is almost a straight line, while the other side edge of the paper 11 is curved and slack is generated. As the paper 11 at the straight line side correctly contacts the manual cutter blade 24, the operator of the printer apparatus 10 can pull the paper 11 to cut the paper 11 correctly.

Further, since the skewed guide 30 needs no drive force, the skewed guide 30 can be produced at a low cost and in a simple mechanism.

(A Fifth Embodiment)

Figure 9:
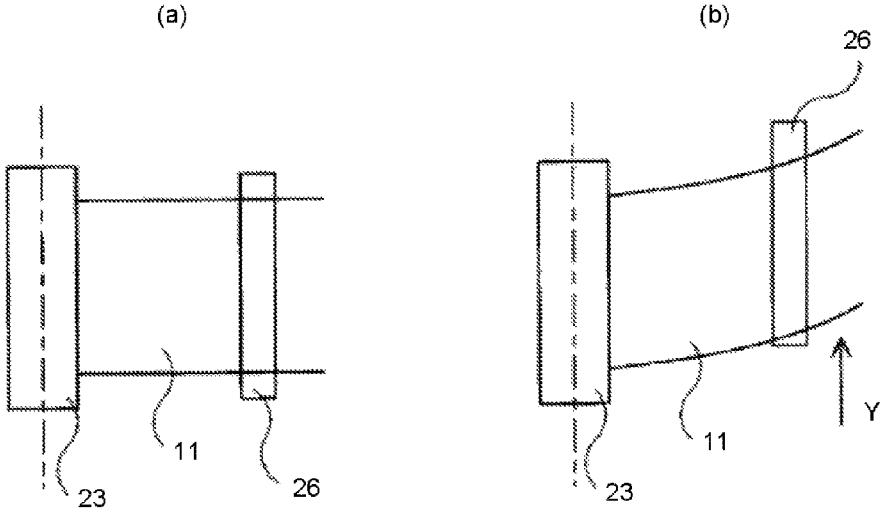
FIG. 9 illustrates movement of a discharge port in a width direction of paper in the printer apparatus according, to a fifth embodiment.

FIG. 9 illustrates the fifth embodiment.

FIG. 9(*a*) illustrates a state where the paper 11 conveyed by the second feed roller 23 is conveyed in a straight direction. FIG. 9(*b*) illustrates a state where the discharge port 26 has moved in the width direction of the paper 11 after the front end of the paper 11 extends from the discharge port 26.

In the fifth embodiment, the paper discharge port 26 is provided with a moving mechanism. As shown in FIG. 9(*a*), the printed paper 11 is clamped and conveyed by the second feed roller 23 and the idle roller 22 towards the discharge port 26. Then the front end of the paper 11 then extends out of the printer apparatus 10 from the discharge port 26. In this state, as shown in FIG. 9(*b*), the paper discharge port 26 is moved in a Y direction by a discharge port moving mechanism (not shown).

In this way, one side edge of the paper 11 is almost a straight line, while the other side edge is curved and slack is generated. Since the paper 11 at the straight line side correctly contacts the manual cutter blade 24, the operator of the printer apparatus 10 can pull the paper 11 to cut the paper 11 correctly.

Figure 10:
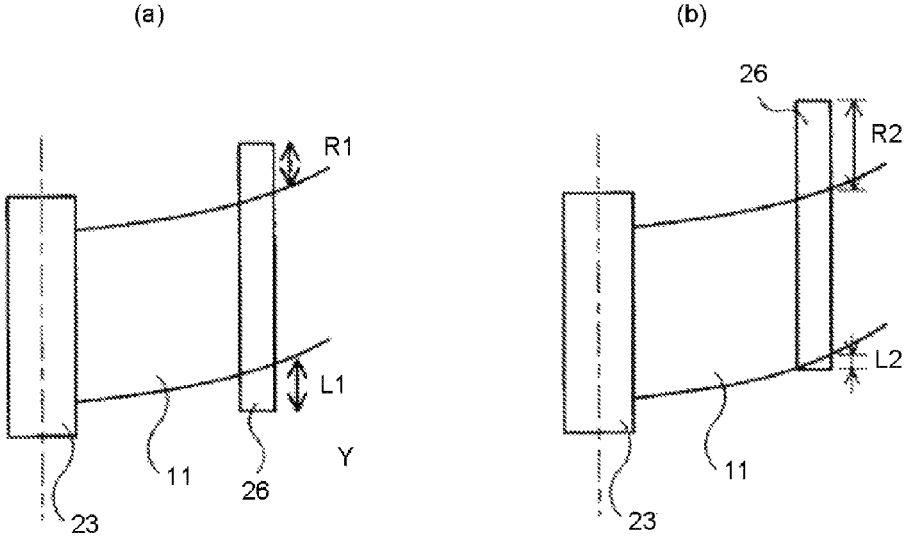
FIG. 10 illustrates the positional relation between two sides of a paper and two sides of the discharge port, according to the present embodiments.

Next, FIG. 10 illustrates distances between each side of the paper 11 and each corresponding side of the discharge port 26. The distances between each side of the paper 11 and each corresponding side of the discharge port 26 are set to be the same in FIG. 10(*a*). However, the distances between each side of the paper 11 and each corresponding side of the discharge port 26 are set to be different in the width direction in FIG. 10(*b*).

In the first to fourth embodiments, the paper skewed conveyance section is arranged between the second feed roller 23 and the discharge port 26. The paper 11 is supposed to be cut, for example, from the X point shown in FIG. 3. However, as shown in FIG. 10(*a*), if the slantingly conveyed paper 11 and the discharge port 26 are in a relation that the distance between the left side of the paper and the left side of the discharge port is the same as that between the right side end of the paper and the right side end of the discharge port, that is, L1=R1, the operator may not know which end the paper should be cut from.

Therefore, as shown in FIG. 10(*b*), the discharge port 26 is arranged in such a manner that the slantingly conveyed paper 11 and the discharge port 26 are in a relation that a distance L2 between the a cutting start side of the paper) and the corresponding discharge port side is smaller than a distance R2 between the cutting completion side of the paper and the corresponding discharge port side.

In this way, the operator can easily know the paper should be cut from which end.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer apparatus, comprising:

a printing section configured to print on a rolled paper;

a discharge port;

a conveyance roller configured to convey the paper to the discharge port so that an end of the paper extends from the discharge port;

a manual cutter blade positioned downstream of the conveyance roller in a paper conveying direction and upstream of the discharge port in the paper conveying direction, the manual cutter blade being configured to contact the paper and cut the paper in a manual cutting operation; and a skewed conveyance section positioned downstream of the conveyance roller in the paper conveying direction and configured to skew the paper relative to the conveyance roller so that a first side edge of the paper between the manual cutter blade and the discharge port has less slack than a second side edge of the paper opposite the first side edge of the paper.

2. The apparatus according to claim 1, wherein the skewed conveyance section comprises a skewed roller having a rotation axis which is not parallel to a rotation axis of the conveyance roller.

3. The apparatus according to claim 1, wherein the skewed conveyance section comprises a roller having a rotation axis parallel to a rotation axis of the conveyance roller and having a diameter of a first end that is different from a diameter of a second end.

4. The apparatus according to claim 1, wherein the skewed conveyance section comprises a plurality of rollers having different roller diameters, the plurality of rollers being rotatable around a single rotation axis that is parallel to a rotation axis of the conveyance roller.

5. The apparatus according to claim 1, wherein the skewed conveyance section comprises a slanting guide positioned between the conveyance roller and the discharge port, the slanting guide having opposite sides in a width direction of the paper that have different thicknesses in a direction normal to the surface of the paper.

6. The apparatus according to claim 1, wherein the skewed conveyance section is controlled to convey the paper only after the front end part of the paper extends from the discharge port.

7. The apparatus according to claim 6, wherein, a distance between a first side of the paper extending from the discharge port and a corresponding first side of the discharge port is different from a distance between a second side of the paper and a corresponding second side of the discharge port.

8. A method of conveying a rolled paper, the method comprising the steps of:

conveying the paper with a conveyance roller to a discharge port so that an end of the paper extends from the discharge port;

positioning the paper with a skewed conveyance section positioned downstream of the conveyance roller in the paper conveying direction so that the paper downstream of the skewed conveyance section in the paper conveying direction is skewed relative to the conveyance roller; and positioning the paper relative to a manual cutter blade positioned downstream of the conveyance roller in the paper conveying direction and upstream of the discharge port in the paper conveying direction so that a first side edge of the paper between the manual cutter blade and the discharge port has less slack than a second side edge of the paper opposite the first side edge of the paper.

9. The method according to claim 8, wherein the skewed conveyance section comprises a skewed roller having a rotation axis which is not parallel to a rotation axis of the conveyance roller.

10. The method according to claim 8, wherein the skewed conveyance section comprises a roller having a rotation axis parallel to a rotation axis of the conveyance roller and having a diameter of a first end that is different from a diameter of a second end.

11. The method according to claim 8, wherein the skewed conveyance section comprises a plurality of rollers having different roller diameters, the plurality of rollers being rotatable around a single rotation axis that is parallel to a rotation axis of the conveyance roller.

12. The method according to claim 8, wherein the skewed conveyance section comprises a slanting guide positioned between the conveyance roller and the discharge port, the slanting guide having opposite sides in a width direction of the paper that have different thicknesses in a direction normal to the surface of the paper.

13. The method according to claim 8, wherein, a distance between the second side edge of the paper extending from the discharge port and a corresponding second side of the discharge port is larger than a distance between the first side edge of the paper and a corresponding first side of the discharge port.

14. The method according to claim 13, further comprising cutting the paper with the manual cutter blade beginning from the first side edge of the paper.

15. The method according to claim 8, wherein the skewed conveyance section is controlled to convey the paper only after the front end part of the paper extends from the discharge port.

16. The method according to claim 8, wherein, the step of positioning the paper with the skewed conveyance section is performed only after the front end part of the paper extends from the discharge port.

17. The method according to claim 8, further comprising:

cutting the paper in a manual cutting operation beginning with the first side edge of the paper, wherein the distance between the first side edge of the paper extending from the discharge port and a corresponding first side of the discharge port is smaller than a distance between the second side edge of the paper and a corresponding second side of the discharge port.

* * * * *